US011522283B2

(12) United States Patent
Krishnamachari et al.

(10) Patent No.: US 11,522,283 B2
(45) Date of Patent: Dec. 6, 2022

(54) WIRELESS RADIO UNITS THAT INCLUDE ANTENNA SYSTEMS HAVING COAXIAL FEED CABLES THAT ARE SELECTIVELY CONNECTED TO AN RF GROUND PLANE

(71) Applicant: ARRIS Enterprises LLC, Suwanee, GA (US)

(72) Inventors: Anand Krishnamachari, Campbell, CA (US); Douglas Blake Kough, San Jose, CA (US); Peter H. Liu, San Jose, CA (US)

(73) Assignee: ARRIS Enterprises LLC, Suwanee, GA (US)

( * ) Notice: Subject to any disclaimer, the term of this patent is extended or adjusted under 35 U.S.C. 154(b) by 140 days.

(21) Appl. No.: 17/151,419

(22) Filed: Jan. 18, 2021

(65) Prior Publication Data

US 2021/0226329 A1 Jul. 22, 2021

Related U.S. Application Data

(60) Provisional application No. 62/963,285, filed on Jan. 20, 2020.

(51) Int. Cl.

| | |
|---|---|
| ***H01Q 1/50*** | (2006.01) |
| ***H01Q 5/30*** | (2015.01) |
| ***H01Q 1/48*** | (2006.01) |

(52) U.S. Cl.
CPC ..... *H01Q 1/50* (2013.01); *H01Q 1/48* (2013.01); *H01Q 5/30* (2015.01)

(58) Field of Classification Search
CPC ..... H01Q 1/50; H01Q 5/30; H01Q 1/48
See application file for complete search history.

(56) References Cited

U.S. PATENT DOCUMENTS 10,283,947 B2 * 5/2019 Chen ..... H02G 3/0456

* cited by examiner

*Primary Examiner* — Andrea Lindgren Baltzell
(74) *Attorney, Agent, or Firm* — Stewart M. Wiener; Myers Bigel, P.A.

(57) ABSTRACT

Antenna systems for access points and other wireless radio units include an RF ground plane, a radiating element mounted in front of the RF ground plane, and a coaxial feed cable coupled to the radiating element. The cable jacket includes a first opening that exposes a first portion of an outer conductor of the coaxial feed cable so that the cable jacket is on either side of the first opening along a longitudinal direction of the coaxial feed cable. The first portion of the outer conductor is galvanically connected to the RF ground plane via a first direct galvanic connection.

20 Claims, 7 Drawing Sheets

WIRELESS RADIO UNITS THAT INCLUDE ANTENNA SYSTEMS HAVING COAXIAL FEED CABLES THAT ARE SELECTIVELY CONNECTED TO AN RF GROUND PLANE

CROSS-REFERENCE TO RELATED APPLICATION

The present application claims priority under 35 U.S.C. § 119 to U.S. Provisional Patent Application Ser. No. 62/963,285, filed Jan. 20, 2020, the entire content of which is incorporated herein by reference as if set forth in its entirety.

FIELD

The present invention relates generally to communications systems and, more particularly, to wireless radio units that include antenna systems having radiating elements that are fed using coaxial feed cables.

BACKGROUND

Many end user or "client" electronic devices communicate with other electronic devices over wireless communications networks. Each client electronic device may include a networking subsystem that implements one or more network interfaces. The one or more network interfaces may include network interfaces that allow the client electronic device to communicate, for example, over a cellular network (UMTS, LTE, etc.), a wireless local area network ("WLAN") that operates under the Institute of Electrical and Electronics Engineers ("IEEE") 802.11 standard (which is often referred to as a Wi-Fi® network), a Bluetooth® wireless network, Zigbee® wireless network, and the like. The client electronic device can establish a communication connection with an electronic device of a wireless communication network (referred to herein as a network electronic device) that includes a networking subsystem that has a corresponding network interface. For example, in a WLAN that is compatible with an IEEE 802.11 standard, a client electronic device may associate with a network electronic device that is commonly referred to as an access point. The client electronic device may wirelessly communicate with the access point in order to connect to another network, such as the Internet. As another example, in a cellular network, a client electronic device may wirelessly communicate with a base station radio via a base station antenna of the cellular network.

The wireless communications between a client electronic device (e.g., a smartphone, a computer, etc.) and a network electronic device (e.g., an access point, a base station antenna/radio, etc.) may be two-way communications. In many systems, so-called frequency division duplexing ("FDD") is used where the "downlink" communications from the network electronic device to the client electronic device are transmitted in a first frequency band, and the "uplink" communications from the client electronic device to the network electronic device are transmitted in a second, different frequency band. While the first and second frequency bands are non-overlapping, they are typically close to each other in frequency so that the radiating elements of the antenna systems that are used to transmit and the receive the wireless communications can be used for both the uplink and downlink communications. In other systems, time division duplexing ("TDD") is used where both downlink and uplink communications are transmitted in the same frequency band, but during different discrete time periods that are referred to as time slots.

As is well known in the art, wireless communication systems may generate passive intermodulation product ("PIM") distortion. PIM distortion is a form of electrical interference that may occur, for example, when two or more RF signals encounter non-linear electrical junctions or materials along an RF transmission path. Such non-linearities may act like a mixer causing the RF signals to generate new RF signals at mathematical combinations of the original RF signals. These newly generated RF signals are referred to as "intermodulation products." The intermodulation products may fall within the bandwidth of existing RF signals. For example, in FDD system, signals transmitted through a network or client electronic device may generate intermodulation products that fall within a receive band for the electronic device. The intermodulation products appear as noise that degrade the signal-to-noise ratio of the received RF signals. This increase in the noise level may make it necessary to reduce the data rate and/or the quality of service for the received RF signals.

Intermodulation products arise because non-linear systems generate harmonics in response to sinusoidal inputs. For example, when a signal having a first frequency $S_{f1}$ is input to a non-linear system, the resulting output signal will include sub-components at integer multiples of the input frequency. When two or more signals having different frequencies are input to a non-linear system, intermodulation products arise. It should be noted that the signals may be signals that are intentionally input to the system, or undesired noise signals that couple into the system. As a simple example, consider a composite input signal x(t) to a non-linear system that includes signals (which may be desired signals or noise signals) at three different frequencies:

$$x(t)=A_1 \sin(2\pi f_1 t+\varphi_1)+A_2 \sin(2\pi f_2 t+\varphi_2)+A_3 \sin(2\pi f_3 t+\varphi_3) \quad (1)$$

In Equation (1), $A_i$ and $\varphi_i$ are the respective amplitudes and phases of the three signals at their respective frequencies $f_1$, $f_2$, $f_3$. If these signals are passed through a non-linearity, the resulting output signal will include components at the frequencies $f_1$, $f_2$, $f_3$ of the three input signals (which are referred to as the fundamental components), as well as linear combinations of these fundamental components having the form:

$$k_1 f_1+k_2 f_2+k_3 f_3 \quad (2)$$

where $k_1$, $k_2$, $k_3$ are arbitrary integers which can have positive or negative values. These components are the intermodulation products, and will have amplitudes and phases that are a function of the non-linearity and the composite input signal x(t).

The order of an intermodulation product is the sum of the absolute value of the coefficients $k_i$ included in the intermodulation product. In the above example where the composite input signal x(t) includes signals at three different frequencies, the second order intermodulation products are the intermodulation products where:

$$|k_1|+|k_2|+|k_3|=2, \text{ where } |k_1|,|k_2|,|k_3|<2 \quad (3)$$

In IEEE 802.11 Wi-Fi networks, the second order intermodulation are often of particular concern, as electronic devise operating in these networks may communicate in both the 2.4 GHz and 5.8 GHz frequency bands (as well as potentially other frequency bands, such as the 60 GHz frequency band). Second order intermodulation products that may be generated when a 2.4 GHz signal is transmitted by the electronic device transmission may be in the vicinity of the 5.8 GHz receive band. In cellular networks, the odd-order intermodulation products (and in particular the third order intermodulation products) are typically of the most interest, as these intermodulation products are the ones that tend to fall in the vicinity of the receive bands.

SUMMARY

Pursuant to embodiments of the present invention, antenna systems are provided that include an RF ground plane, a radiating element mounted in front of the RF ground plane, and a coaxial feed cable coupled to the radiating element, the coaxial feed cable including a center conductor, a dielectric spacer that surrounds the center conductor, an outer conductor that surrounds the dielectric spacer, and a cable jacket that surrounds the outer conductor. The cable jacket includes a first opening that exposes a first portion of the outer conductor, the cable jacket being on either side of the first opening along a longitudinal direction of the coaxial feed cable. The first portion of the outer conductor is galvanically connected to the RF ground plane via a first direct galvanic connection.

In some embodiments, the radiating element may be configured to operate in a first operating frequency band, and the first opening in the cable jacket may be at a distance from a first end of the coaxial feed cable that is approximately one quarter of a wavelength that corresponds to a center frequency of the first operating frequency band.

In some embodiments, the radiating element may also be configured to operate in a second operating frequency band that is different than the first operating frequency band. In some cases, twice the center frequency of the first operating frequency band is within 25% of a center frequency of the second operating frequency band.

In some embodiments, the cable jacket may include a second opening that exposes a second portion of the outer conductor, the cable jacket being on either side of the first opening along a longitudinal direction of the coaxial feed cable, and wherein the second portion of the outer conductor is galvanically connected to the RF ground plane via a second direct galvanic connection. The second opening in the cable jacket may, for example, be at a distance from a second end of the coaxial feed cable that is approximately one quarter of the wavelength that corresponds to a center frequency of the first operating frequency band.

In some embodiments, the first portion of the outer conductor may be galvanically connected to the RF ground plane via a solder joint.

In some embodiments, the first portion of the outer conductor may be galvanically connected to the RF ground plane via a clip. The clip may include at least one insulation piercing contact. The clip may also hold the coaxial feed cable in contact with a printed circuit board that includes the RF ground plane.

In some embodiments, the first portion of the outer conductor may be galvanically connected to the RF ground plane via a conductive tape.

In some embodiments, the first opening may divide the cable jacket into first and second spaced apart cable jacket segments.

In some embodiments, the RF ground plane may be implemented in a printed circuit board and the radiating element may be mounted to extend from a front side of the printed circuit board, and the coaxial feed cable may extend through an opening in the printed circuit board to connect a circuit element mounted on a back side of the printed circuit board to the radiating element.

In some embodiments, the cable jacket may include a second opening that exposes a second portion of the outer conductor, and the second portion of the outer conductor may be galvanically connected to the RF ground plane via a second direct galvanic connection. In such embodiments, the first direct galvanic connection may be on the front side of the printed circuit board and the second direct galvanic connection may be on the back side of the printed circuit board.

In some embodiments, the antenna unit is part of an access point or is a wireless radio unit of a cellular communication system.

In some embodiments, the radiating element may be configured to operate in a first operating frequency band and in a second operating frequency band that is different than the first operating frequency band, and the cable jacket may include a second opening that exposes a second portion of the outer conductor, and the second portion of the outer conductor may be connected to the RF ground plane by a second direct galvanic connection.

Pursuant to further embodiments of the present invention, antenna systems are provided that include a printed circuit board that includes a metallization layer that is configured to be maintained at RF ground when the antenna system is in operation, a radiating element that is configured to operate in a first operating frequency band, and a feed cable that is coupled to the radiating element, the feed cable including a conductor and a cable jacket that surrounds the conductor. A first central portion of the conductor of the feed cable is connected to the RF ground plane via a first galvanic connection that is a direct galvanic connection.

In some embodiments, a first end of the conductor of the feed cable may be connected to the RF ground plane via a second galvanic connection and a second end of the conductor of the feed cable may be connected to the first radiating element via a third galvanic connection In some embodiments, the first galvanic connection may be a first solder joint. In other embodiments, the first portion of the conductor may be galvanically connected to the RF ground plane via a clip.

In some embodiments, the central portion of the conductor of the feed cable may be connected to the RF ground plane at a distance from a first end of the feed cable that is approximately one quarter of a wavelength that corresponds to a center frequency of the first operating frequency band.

In some embodiments, the radiating element may also be configured to operate in a second operating frequency band that is different than the first operating frequency band. For example, 23. For example, the radiating element may be configured to operate in a second operating frequency band where twice the center frequency of the first operating frequency band is within 25% of a center frequency of the second operating frequency band.

In some embodiments, a second central portion of the conductor of the feed cable may be connected to the RF ground plane via a fourth galvanic connection that is a direct galvanic connection. The fourth galvanic connection may, for example, be at a distance from a second end of the feed cable that is approximately one quarter of the wavelength that corresponds to a center frequency of the first operating frequency band.

In other embodiments, the fourth galvanic connection may be at a distance from a first end of the feed cable that is approximately one quarter of the wavelength that corresponds to a center frequency of the second operating frequency band.

In some embodiments, the cable jacket of the feed cable may include a first opening that exposes the first central portion of the conductor, and the first opening may divide the cable jacket into first and second spaced apart cable jacket segments.

In some embodiments, the radiating element may be mounted to extend from a front side of the printed circuit board, and the feed cable may extend through an opening in the printed circuit board to connect a circuit element mounted on a back side of the printed circuit board.

In some embodiments, the feed cable may be a coaxial feed cable, and the conductor may be an outer conductor of the coaxial feed cable.

In some embodiments, the antenna unit may be part of an access point.

Pursuant to additional embodiments of the present invention, antenna systems are provided that include a printed circuit board that has a metallization layer that is configured to be maintained at RF ground when the antenna system is in operation, a radiating element that is configured to operate in a first operating frequency band, and a coaxial feed cable that is coupled to the radiating element, the coaxial feed cable including an outer conductor and a cable jacket that surrounds the outer conductor. The cable jacket includes a first opening that exposes a first portion of the outer conductor and a second opening that exposes a second portion of the outer conductor, and the first portion and the second portion of the outer conductor are connected to the metallization layer through the respective first and second openings. The first and second openings are each between a first section of the cable jacket that is adjacent a first end of the coaxial feed cable and a second section of the cable jacket that is adjacent a second end of the coaxial feed cable.

In some embodiments, the first opening in the cable jacket may be at a distance from a first end of the coaxial feed cable that is approximately one quarter of a wavelength that corresponds to a center frequency of the first operating frequency band.

In some embodiments, the second opening in the cable jacket may be at a distance from a second end of the coaxial feed cable that is approximately one quarter of a wavelength that corresponds to a center frequency of the first operating frequency band.

In some embodiments, the radiating element may also be configured to operate in a second operating frequency band that is different than the first operating frequency band.

In some embodiments, twice the center frequency of the first operating frequency band may be within 25% of a center frequency of the second operating frequency band.

In some embodiments, the first and second portions of the outer conductor may be connected to the RF ground plane via respective first and second solder joints.

In some embodiments, the first portion of the outer conductor may be galvanically connected to the RF ground plane via a clip.

Pursuant to still further embodiments of the present invention, methods of suppressing the generation of intermodulation products are provided in which a first opening is formed in a cable jacket of a coaxial feed cable for a radiating element of an antenna system to expose a first central portion of an outer conductor of the coaxial feed cable. The first central portion of the outer conductor is then galvanically connecting the to an RF ground plane of the antenna system.

In some embodiments of these methods, the first central portion of the outer conductor that is exposed by the first opening may be at a distance from a first end of the coaxial feed cable that is approximately one quarter of a wavelength that corresponds to a center frequency of an operating frequency band of the radiating element.

In some embodiments of these methods, the radiating element is also configured to operate in a second operating frequency band that is different than the first operating frequency band.

In some embodiments, the method may further comprise forming a second opening in the cable jacket to expose a second central portion of the outer conductor of the coaxial feed cable and then galvanically connecting the second central portion of the outer conductor to the RF ground plane.

In some embodiments, the second opening in the cable jacket may be at a distance from a second end of the coaxial feed cable that is approximately one quarter of the wavelength that corresponds to the center frequency of the first operating frequency band.

In some embodiments, the radiating element may be configured to operate in a first operating frequency band and in a second operating frequency band that is different than the first operating frequency band. In these embodiments, the method may further comprise forming a second opening in the cable jacket to expose a second central portion of the outer conductor of the coaxial feed cable and then galvanically connecting the second central portion of the outer conductor to the RF ground plane. The second central portion of the outer conductor may be at a distance from either a first end or a second end of the coaxial feed cable that is approximately one quarter of a wavelength that corresponds to a center frequency of the second operating frequency band of the radiating element.

In some embodiments, the RF ground plane may be part of a printed circuit board, and the first central portion of the outer conductor may be galvanically connected to the RF ground plane via a first solder joint and the second central portion of the outer conductor may be galvanically connected to the RF ground plane via a second solder joint. The first solder joint may be on the front side of the printed circuit board and the second solder joint may be on the back side of the printed circuit board.

In some embodiments, the first opening may divide the cable jacket into first and second spaced apart cable jacket segments.

DETAILED DESCRIPTION

Figure 1:
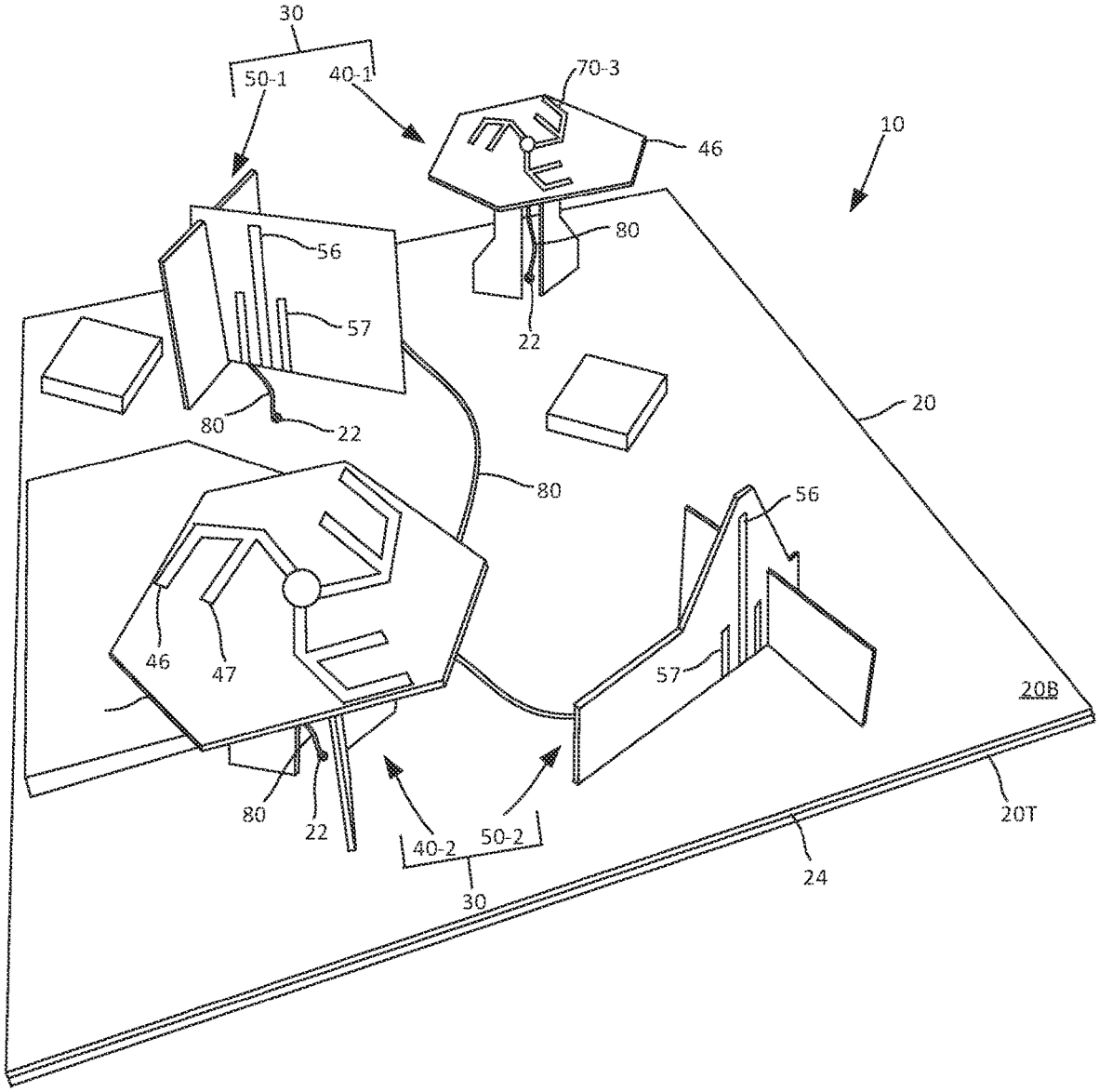
FIG. 1 is a schematic bottom perspective view illustrating an example of various of the internal electronic components of a Wi-Fi access point including the antenna system thereof.

Antenna systems that are used in wireless radio units such as Wi-Fi access points, Citizens Band Radio Service ("CBRS") radio units and cellular base stations typically include one or more radiating elements that are mounted in front of an RF ground plane. The RF ground plane may provide a common ground reference for the radiating elements, and may also serve to reflect any backwardly directed radiation emitted by the radiating elements in the forward direction. In many applications, each radiating element may be fed by one or more coaxial feed cables. Each coaxial feed cable may be used to connect the radiators of the radiating elements (which may be, for example, one or more dipole radiators, patch radiators, etc.) to elements of a feed network (e.g., an RF transmission line, a diplexer, etc.) or directly to front end RF components such as RF amplifiers and the like. At least a portion of each coaxial feed cable may extend along and/or in front of the RF ground plane.

In certain situations, the coaxial feed cables may interact with the RF ground plane or other elements of a wireless radio unit. This interaction may generate PIM distortion or other noise that can degrade the performance of the wireless radio unit. For example, when a coaxial feed cable is mounted on a printed circuit board that includes an RF ground plane, current that is not at RF ground may pass along the outer conductor of the coaxial cable feed cable and/or a standing wave may be generated between the coaxial feed cable and the printed circuit board. If either of these situations arise, intermodulation products or other RF noise (e.g., coupling of energy to other nearby radiating elements) may potentially be generated. As discussed above, the resulting PIM distortion/noise may degrade the performance of the wireless radio unit or of other nearby wireless radio units.

Pursuant to embodiments of the present invention, antenna systems are provided that include at least one radiating element that is mounted in front of an RF ground plane. These antenna systems may be part of a wireless radio unit such as, for example, a Wi-Fi access point or a CBRS radio unit. These antenna systems include a feed cable, such as a coaxial feed cable, that is used to feed RF signals between a radiating element and other circuit elements of the wireless radio unit. The cable jacket of the coaxial feed cable includes a first opening that exposes a first portion of the outer conductor of the coaxial feed cable. The first opening may be in a central portion of the coaxial feed cable so that the cable jacket extends on either side of the first opening along a longitudinal direction of the coaxial feed cable. The exposed first portion of the outer conductor is connected to the RF ground plane via a first direct galvanic connection. Here, a "galvanic connection" refers to an electrical connection that is through conductors as opposed to a capacitive or inductive connection. Therefore, a galvanic connection may involve direct coupling. A portion of an outer conductor of a coaxial feed cable is considered to have a "direct" galvanic connection to the RF ground plane if an electrical connection exists between the portion of the outer conductor and the RF ground plane that does not extend through the ends of the coaxial feed cable. By connecting the outer conductor of the coaxial feed cable to the RF ground plane via a direct galvanic connection, it has been found that intermodulation products and/or other RF noise generated by the coaxial feed cable may be suppressed, which may reduce the extent to which transmissions from the radiating element can interfere with the receive channel of a wireless radio unit that includes the antenna system, or the receive channels of other nearby wireless radio units. The first portion of the outer conductor may be directly galvanically connected to the RF ground plane by, for example, a solder joint, a clip or conductive tape.

In some embodiments, the first opening in the cable jacket may be at a distance from a first end of the coaxial feed cable that is approximately one quarter of a wavelength (also called herein an "operating wavelength") of the radiating element. The operating wavelength is the wavelength that corresponds to a center frequency of an operating frequency band of the radiating element. In some embodiments, the cable jacket may optionally include a second opening that exposes a second portion of the outer conductor, and the second portion of the outer conductor may also be directly galvanically connected to the RF ground plane. In some cases, the second opening in the cable jacket may be located at a distance from a second end of the coaxial feed cable that is approximately one quarter of the operating wavelength of the radiating element. In other cases, the radiating element may be a dual-band radiating element that operates in first and second operating frequency bands. A dual-band radiating element has first and second operating wavelengths that are the wavelengths corresponding to the center frequencies of the respective first and second operating frequency bands of the dual-band radiating element. With dual-band radiating elements, the first and second openings in the cable jacket may be located approximately one quarter of the first (or second) operating wavelength from the respective first and second ends of the cable. Alternatively, the first opening may be located approximately one quarter of the first operating wavelength from the first end of the coaxial feed cable, and the second opening may be located approximately one quarter of the second operating wavelength from the second end of the coaxial feed cable.

In some embodiments, the RF ground plane may be implemented in a printed circuit board and the radiating element may be mounted to extend from a front side of the printed circuit board. In such embodiments, the coaxial feed cable may extend through an opening in the printed circuit board to connect a circuit element that is mounted on a back side of the printed circuit board.

In some embodiments, the openings in the cable jacket may extend a full 360° around the circumference of the cable in order to divide the cable jacket into first and second spaced apart cable jacket segments. In other embodiments, the openings in the cable jacket may extend less than all of the way around the circumference of the cable.

Pursuant to further embodiments of the present invention, antenna systems are provided that include a printed circuit board that has a metallization layer that is configured to be maintained at RF ground when the antenna system is in operation. One or more radiating elements are mounted on the printed circuit board. These radiating elements are configured to operate in at least a first operating frequency band. A coaxial feed cable is coupled to a first of the radiating elements, the coaxial feed cable including an outer conductor and a cable jacket that surrounds the outer conductor. The cable jacket includes first and second openings that expose respective first and second portions of the outer conductor. The first and second portions of the outer conductor are connected to the metallization layer through the respective first and second openings, wherein the first and second openings are each between a first section of the cable jacket that is adjacent a first end of the coaxial feed cable and a second section of the cable jacket that is adjacent a second end of the coaxial feed cable.

Pursuant to additional embodiments of the present invention, methods of suppressing the generation of intermodulation products are provided in which a first opening is formed in a cable jacket of a coaxial feed cable for a radiating element of an antenna system to expose a first central portion of an outer conductor of the coaxial feed cable. The first central portion of the outer conductor is then directly galvanically connected to an RF ground plane of the antenna system to suppress intermodulation product generation.

FIG. 1 is a schematic bottom perspective view of an example of various internal electronic components of a Wi-Fi access point 10. An exterior housing of access point 10 is omitted from FIG. 1 in order to show selected internal electronic components of the access point.

As shown in FIG. 1, the Wi-Fi access point 10 includes a printed circuit board 20 having a top surface 20T and a bottom surface 20B. The printed circuit board 20 may be a multilayer printed circuit board that includes an RF ground plane 24. The RF ground plane 24 may, for example, be implemented as a planar metal layer that is implemented in an interior layer of the printed circuit board 20 as shown in FIG. 1. The access point 10 further includes an antenna system 30 that comprises a plurality of radiating elements 40-1, 40-2, 50-1, 50-2 and coaxial feed cables 80. Note that herein two-part reference numerals (which are separated by a dash) may sometimes be used to designate multiple instances of the same or similar components. When such two-part reference numerals are used, the full reference number will be used to refer to a specific instance of the component, while only the first part of the reference number is used to refer to the components collectively.

As shown in FIG. 1, each radiating element 40, 50 is mounted to extend downwardly from the bottom surface 20B of printed circuit board 20 (note that in the view of FIG. 1 access point 10 is upside down from the orientation in which it will be mounted for use). Each radiating element 40, 50 may include one or more radiators such as dipole radiators 46, 56, 47, 57. The radiating elements 40, 50 are shown as being dual-band radiating elements in FIG. 1 that each include radiators that operate in two different frequency bands (i.e., radiators 46 are operate in the lower frequency band, and radiators 47, 57 operate in the higher frequency band), but it will be appreciated that the radiating elements 40, 50 could alternatively be designed to operate in more or fewer frequency bands. A plurality of baseband and RF electronic components of the access point 10 (mostly not shown) including, for example, baseband circuitry, radios, a processor, a memory, duplexers, diplexers, RF amplifiers and the like may be mounted on the printed circuit board 20 (typically these elements are mounted on the top side 20T of printed circuit board 20 to reduce interference with the radiating elements 40, 50) or separate from the printed circuit board 20 (e.g., on a second printed circuit board).

Each radiating element 40, 50 may be fed by a respective one of the coaxial feed cables 80. Coaxial feed cables are a known type of electrical cable that may be used to carry radio frequency ("RF") signals. Each coaxial feed cable 80 may extend between a respective RF circuit element such as, for example, a diplexer or an RF amplifier that is mounted, for example, on the top side 20T of the printed circuit board 20 to a respective one of the radiating elements 40, 50 on the bottom side 20B of the printed circuit board 20. In some cases, the circuit element may instead be an electrical connection, such as a pad on the printed circuit board 20, that is connected to another circuit element (e.g., a diplexer, RF amplifier, etc.) via an RF transmission line on the printed circuit board 20. The coaxial feed cables 80 may transition from the top side 20T to the bottom side 20B of printed circuit board 20 through respective openings 22 that are cut through the printed circuit board 20. Each coaxial feed cable 80 may be used to pass RF signals between a respective one of the RF circuit elements and a respective one of the radiating elements 40, 50.

Figure 2A:
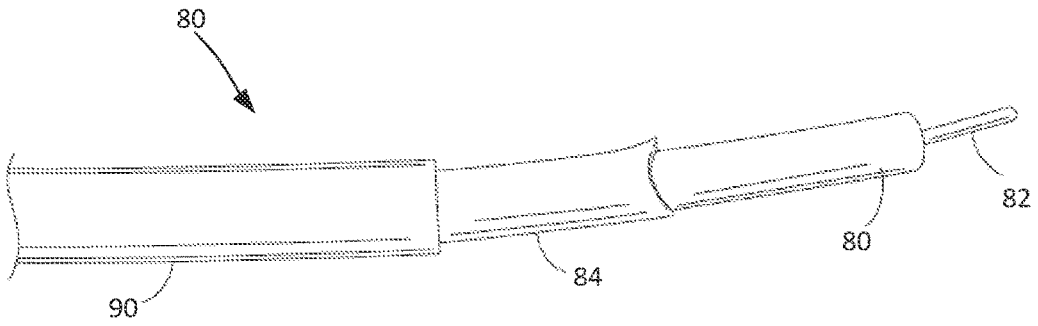
FIG. 2A is a schematic perspective view of one end of an example of a coaxial feed cable that may be used to feed one of the radiating elements of the antenna system of the conventional Wi-Fi access point of FIG. 1.
Figure 2B:
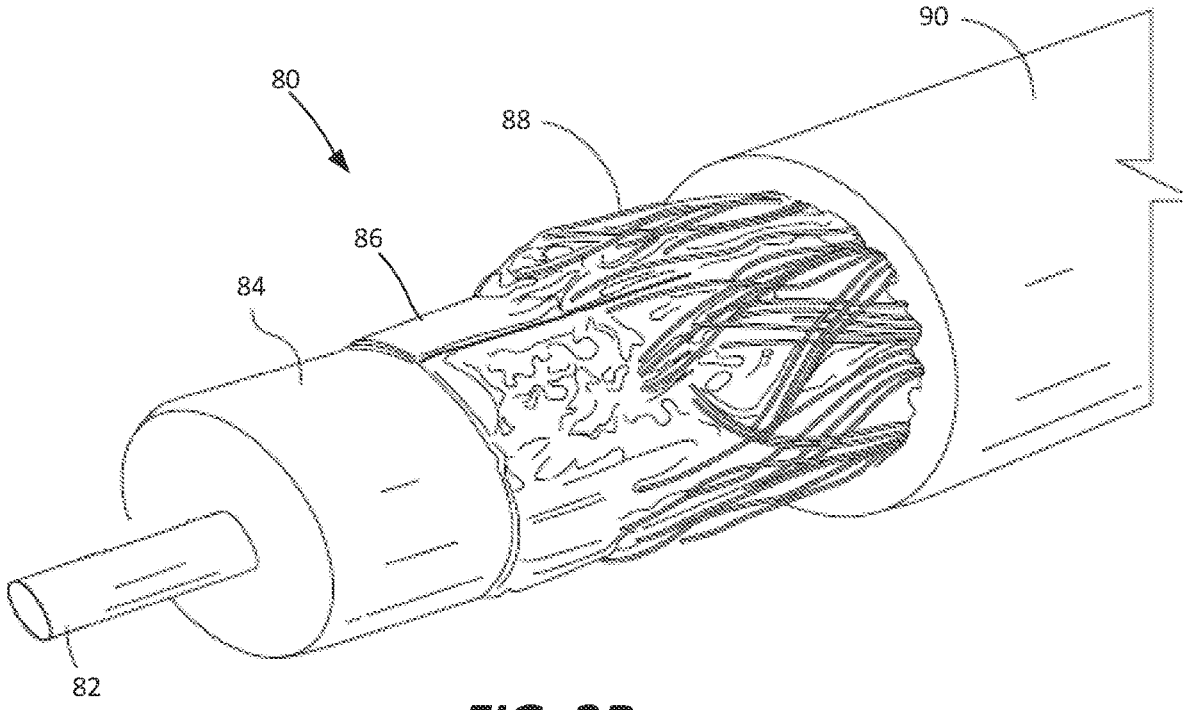
FIG. 2B is an enlarged perspective view of the coaxial feed cable of FIG. 2A.

FIG. 2A is a schematic perspective view of an example of one end of one of the coaxial feed cables 80 that is included in the antenna system 30 of the Wi-Fi access point 10 of FIG. 1. FIG. 2B is an enlarged perspective view of an example of the coaxial feed cable 80 of FIG. 2A. In FIGS. 2A and 2B, portions of the various layers of the coaxial feed cable 80 have been cut away to better illustrate the structure of the coaxial feed cable 80.

As shown in FIGS. 2A-2B, the coaxial feed cable 80 includes a central conductor 82 that is surrounded by a dielectric spacer 84. An optional tape 86 may be bonded to the outside surface of the dielectric spacer 84 (see FIG. 2B). A metallic electrical shield 88 surrounds the central conductor 82, the dielectric spacer 84 and the tape 86. The electrical shield 88 serves as an outer conductor of the coaxial feed cable 80 and hence may also be referred to herein as outer conductor 88. One or more additional electrical shielding tapes (not shown) may surround the metallic electrical shield 88. A cable jacket 90 surrounds the electrical shield 88 to complete the coaxial feed cable 80. The coaxial feed cable 80 may extend in a "longitudinal" direction that is defined by the longitudinal axis of the central conductor 82, and may have a generally round transverse cross-section. The coaxial feed cable 80 may be flexible so that it may be routed within the Wi-Fi access point 10 in a circuitous fashion.

The central conductor 82 may comprise, for example, a copper or copper alloy wire of suitable gauge or a copper or copper alloy-plated aluminum or steel wire. Other conductive materials may also be used to form the central conductor 82. The dielectric spacer 84 may be formed using any suitable insulative material including, for example, polytetrafluoroethylene ("PTFE") or polyethylene. The dielectric constant of the dielectric spacer 84 may be selected in view of, for example, the radii of the central conductor 82 and the electrical shield 88 to provide a desired characteristic impedance for the coaxial feed cable 80. In some embodiments, the dielectric spacer 84 may be applied as a foam that cures to form a solid that surrounds the central conductor 82. The electrical shield 88 may, for example, be implemented using braided shielding wires as shown in FIG. 2B. The electrical shield 88 may, however, be implemented in any suitable fashion including, for example, as a corrugated or non-corrugated annular metal tube. The cable jacket 90 may be formed of any suitable polymeric material, such as a thermoplastic polymer. Suitable materials include, without limitation, PVC, PVDF or FRPE. The cable jacket 90 may be molded or extruded over the outer conductor 88.

Applicants have discovered that the coaxial feed cables 80 of the Wi-Fi access point 10 may be sources of PIM distortion or other RF noise. The coaxial feed cables 80 are often routed along the top surface 20T and/or the bottom surface 20B of printed circuit board 20. For example, in a dual-band Wi-Fi access point that includes radiating elements 40, 50 (and associated baseband and RF circuitry) that operate in multiple frequency bands, interaction between the coaxial feed cables 80 and the printed circuit board 20 (or elements mounted thereon) may generate intermodulation products. While not wishing to be bound by any particular theory, Applicants believe that the intermodulation products may result from current that is not at RF ground passing along the outer conductor of the coaxial cable feed cables 80 and/or from standing waves that may be generated between the coaxial feed cables 80 and the printed circuit board 20.

The above-discussed intermodulation products or other RF noise may cause various problems. For example, access points that are used to form IEEE 802.11 Wi-Fi networks must pass various compliance tests, including tests that place limits on the magnitude of the second order intermodulation products. The above-discussed intermodulation products may be sufficient to cause an access point to fail the necessary tests. Even if a particular access point passes the compliance tests, the intermodulation products may degrade the performance of the access point in operation. For example, second order intermodulation products generated in response to transmissions in the 2.4 GHz band may fall in the vicinity of the receive channel of the 5.8 GHz band, and hence may degrade the performance of dual-band access points (e.g., an access point that operates in both the 2.4 GHz and 5.8 GHz frequency bands), and/or may degrade the performance of other nearby electronic devices (such as client electronic devices) that are operating in the 5.8 GHz frequency band. Moreover, because the position of the coaxial feed cables is often not completely fixed with respect to the printed circuit board, the PIM distortion may change (e.g., become worse after a compliance test has been performed). Similar problems may arise in CBRS wireless radio units and in other types of cellular wireless radio units.

Pursuant to embodiments of the present invention, the PIM distortion that is generated by the coaxial feed cables that extend along the surface of a printed circuit board of an antenna system can be reduced by galvanically connecting central portions of the outer conductors of the coaxial feed cables (i.e., sections of the outer conductors that are not at either end of the coaxial feed cables) to an RF ground plane that is implemented in the printed circuit board. The outer conductors of the coaxial feed cables may be exposed through openings in the respective cable jackets and galvanically connected to the RF ground plane via, for example, solder joints, clips or conductive tape. The galvanic connections may set the potential of the currents flowing along the outer conductors of the coaxial feed cables at RF ground, which may suppress the generation of intermodulation products that may appear as noise to signals received at nearby radiating elements.

In some embodiments, the cable jacket of a first of the coaxial feed cables may include a first opening that exposes a first portion of the outer conductor. This first opening in the cable jacket may be located approximately one quarter of an "operating wavelength" from a first end of the cable, where the operating wavelength corresponds to a center frequency of an operating frequency band of the radiating element that is fed by the coaxial feed cable. The first of the coaxial feed cables may also include a second opening that exposes a second portion of the outer conductor. The second opening may be located approximately one quarter of the operating a wavelength from a second end of the coaxial feed cable. The first and second openings expose the first and second portions of the outer conductor so that they may be galvanically connected to the RF ground plane.

Figure 3A:
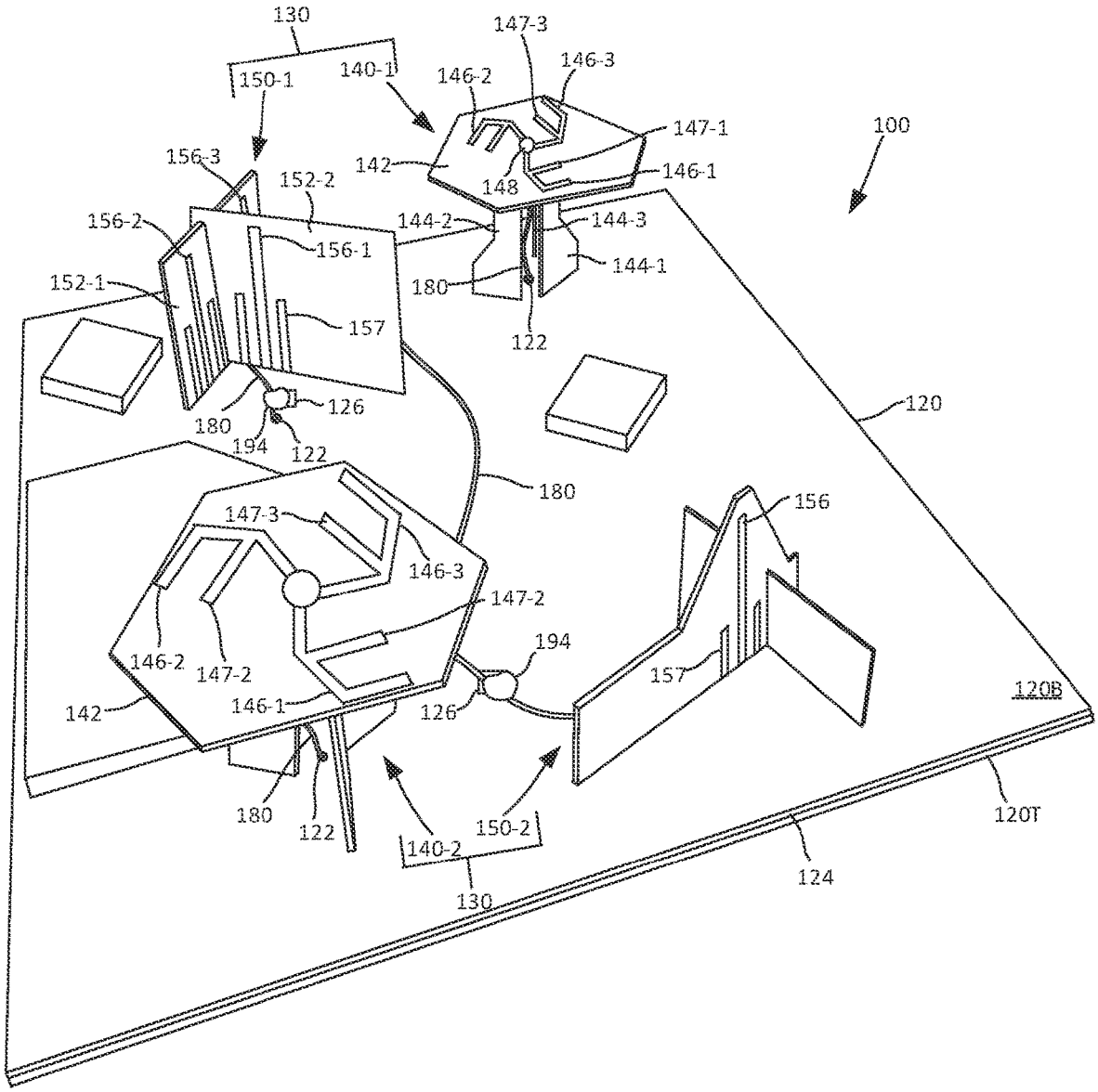
FIG. 3A is a schematic bottom perspective view illustrating various of the internal electronic components an example of of a Wi-Fi access point according to embodiments of the present invention.

FIG. 3A is a schematic bottom perspective view of an example of a Wi-Fi access point 100 according to embodiments of the present invention that illustrates an antenna system 130 thereof. The antenna system 130 includes a plurality radiating elements 140, 150 as well as a plurality of coaxial feed cables 180. The coaxial feed cables 180 may be identical to the coaxial feed cable 80 of FIGS. 2A-2B, except that the coaxial feed cables 180 may have one or more openings in the cable jackets thereof. Accordingly, similar reference numerals are used to identify the components of the coaxial feed cables 80 and 180 (the reference numerals are increased by 100 in coaxial feed cables 180), and further description of the basic components of coaxial feed cables 180 will not be repeated here).

Figure 3B:
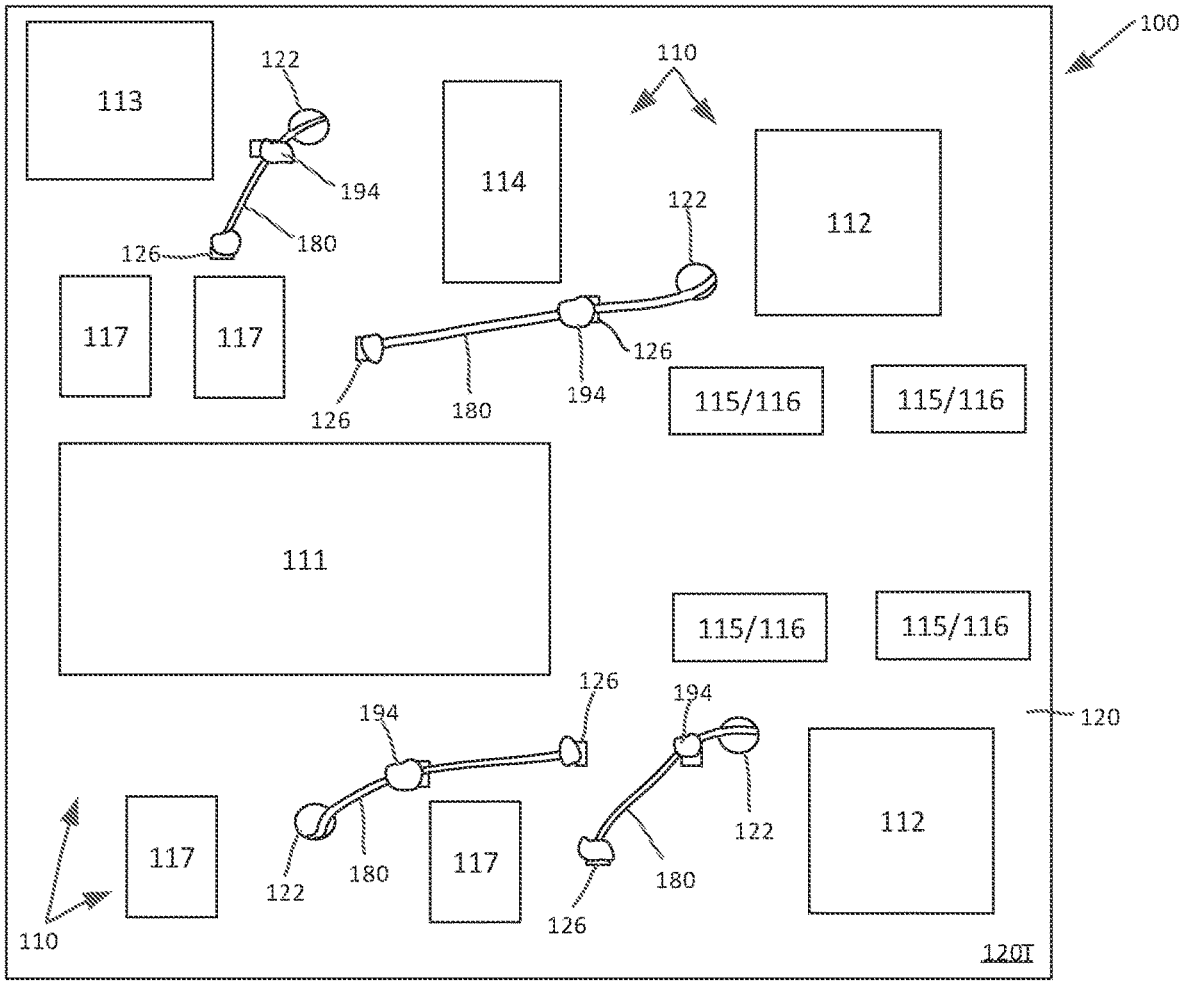
FIG. 3B is a schematic top view of the Wi-Fi access point of FIG. 3A that illustrates baseband and RF circuitry thereof.

The coaxial feed cables 180 are galvanically coupled to an RF ground plane 124 of the antenna system 130 adjacent the respective radiating elements 140, 150 in order to suppress generation of intermodulation products. FIG. 3B is a schematic top plan view of an example of the Wi-Fi access point 100 of FIG. 3A that illustrates the baseband and RF circuitry 110 thereof and shows how the coaxial feed cables 180 may also be galvanically coupled to the RF ground plane 124 adjacent certain of the RF circuitry 110 in order to further suppress generation of intermodulation products.

Referring first to FIG. 3A, the Wi-Fi access point 100 includes a printed circuit board 120 and an antenna system 130. The printed circuit board 120 has a top surface 120T and a bottom surface 120B. The printed circuit board 120 may be a multilayer printed circuit board that includes an RF ground plane 124. The RF ground plane 124 may, for example, be a planar metal layer that is implemented in an interior layer of the printed circuit board 120. In other embodiments, the RF ground plane 124 may be implemented on multiple layers of the printed circuit board 120, and the different portions of the RF ground plane 124 may be electrically connected to each other via plated through holes, vias or other known mechanisms for electrically connecting elements on different layers of a printed circuit board The antenna system 130 include a plurality of radiating elements 140-1, 140-2 and 150-1, 150-2. The radiating elements 140, 150 are mounted to extend forwardly from a major surface of the printed circuit board 120. Since Wi-Fi access points are often (but not always) ceiling mounted devices that are designed to emit RF radiation downwardly, the radiating elements 140, 150 are shown here as being mounted to extend downwardly from the bottom surface 120B of printed circuit board 120.

In the depicted embodiment, the first radiating element 140-1 comprises a radiator printed circuit board 142 that is mounted forwardly of the RF ground plane 124 by three support printed circuit boards 144-1 through 144-3. The first radiating element 140-1 may include one or more radiators such as dipole radiators. In the depicted embodiment, three dipole radiators 146-1 through 146-3 are provided that are formed as conductive traces on a first side of the radiator printed circuit board 142. The three dipole radiators 146-1 through 146-3 have a common feed point 148. The dipole radiators 146-1 through 146-3 are mounted to extend in parallel to the RF ground plane 124, and are situated a predetermined distance forwardly of the RF ground plane 124 (here the forward direction corresponds to the downward direction when the Wi-Fi access point 100 is mounted on a ceiling). In some embodiments, the predetermined distance may be about ¼ of the operating wavelength of radiating element 140-1. The three dipole radiators 146-1 through 146-3 may be configured, for example, to generate a generally semi-spherical radiation pattern or "antenna beam" that extends a full 360° in the azimuth (horizontal) plane. Thus, the radiating element 140-1 may provide generally omnidirectional coverage in the downward and sideward directions. The RF ground plane 124 will mostly reflect upwardly-directed radiation back downwardly, which is why the radiating pattern may have a generally semi-spherical shape as opposed to true omnidirectional (generally spherical) coverage. The first radiating element 140-1 is configured to transmit and receive horizontally polarized RF signals.

The second radiating element 140-2 may be similar or identical to the first radiating element 140-1, and hence further description thereof is omitted here.

The third radiating element 150-1 comprises a pair of radiator printed circuit boards 152-1, 152-2 that are mounted to extend forwardly from the printed circuit board 120 (and hence from the RF ground plane 124). Radiator printed circuit boards 152-1 and 152-2 each include mating slots so that the radiator printed circuit boards 152-1, 152-2 may be joined together in an intersecting arrangement. Each radiator printed circuit board 152-1, 152-2 extends outwardly (in the downward direction when the Wi-Fi access point 100 is mounted on a ceiling) from the printed board 120 and may be arranged perpendicular to the printed circuit board 120. The third radiating element 150-1 includes three dipole radiators 156-1 through 156-3, with the first dipole radiator 156-1 formed as a conductive trace on radiator printed circuit board 152-1 and the second and third dipole radiators 156-2, 156-3 formed as respective conductive traces on radiator printed circuit board 152-2. Each dipole radiator 156-1 through 156-3 is mounted to extend perpendicular to the RF ground plane 124. The three dipole radiators 156-1 through 156-3 may, for example, generate a generally semi-spherical antenna beam. The third radiating element 150-1 is configured to transmit and receive vertically polarized RF signals.

The fourth radiating element 150-2 may be similar or identical to the third radiating element 150-1, and hence further description thereof is omitted here.

The radiating elements 140, 150 may be designed to operate in a first frequency band such as, for example, the 2.4 GHz frequency band (which may extend, for example, from 2.4 GHz to 2.5 GHz). Since the antenna system 130 includes multiple radiating elements 140, 150 that are configured to operate in the 2.4 GHz band, the Wi-Fi access point 100 may transmit signals using multi-input-multi-output ("MIMO") techniques whereby a data stream may be broken into pieces and transmitted over multiple separate channels. Here, the four radiating elements allow the access point 100 to transmit signals using 4×MIMO techniques.

As is also shown in FIG. 3A, in some embodiments, each radiating element 140-1, 140-2, 150-1, 150-2 may be implemented as a dual-band radiating element that is configured to transmit and receive signals in two different operating frequency bands. For example, radiating elements 140-1 and 140-2 may each further include three additional dipole radiators 147-1 through 147-3 that are also fed via the common feed point 148. The dipole radiators 147 may be shorter than dipole radiators 146 (since dipole radiators 147 are designed to operate in a higher frequency band), and the base portion of each dipole radiator 146 (i.e., the portion that connects to the common feed point 148) may also form the base portion of a respective one of the dipole radiators 147. Similarly, radiating elements 150-1 and 150-2 may each further include three additional dipole radiators 157-1 through 157-3 that are also fed via the common feed point 158. The dipole radiators 157 may be shorter than dipole radiators 156. The dipole radiators 147 and 157 may be designed, for example, to operate in a second frequency band such as, for example, the 5.8 GHz frequency band (which may extend, for example, from 5.725 GHz to 5.875 GHz, and which is also often referred to as the 5 GHz frequency band).

Referring to FIG. 3B, the Wi-Fi access point 100 further includes a plurality of baseband and RF electronic components 110 that may be mounted, for example, on the top side 120T of printed circuit board 120. The baseband and RF electronic components 110 may include, for example, baseband circuitry 111, radios 112, a processor 113, memory 114, duplexers 115, RF amplifiers 116, diplexers 117 and the like. The various baseband and RF circuits may be interconnected via RF transmission lines implemented in the printed circuit board 120 (not shown). While the baseband and RF circuitry 110 is mounted on printed circuit board 120 in the depicted embodiment, it will be appreciated that in other cases at least some of the baseband and RF circuitry 110 may be mounted elsewhere (e.g., on a second printed circuit board). The baseband and RF circuitry 110 may be conventional and hence further description thereof will be omitted here.

As shown in FIGS. 3A and 3B, each radiating element 140, 150 may be fed by a respective coaxial feed cable 180. Each coaxial feed cable 180 may have the structure of the coaxial feed cable 80 discussed above with reference to FIGS. 2A-2B. A first end of each coaxial feed cable 180 may be connected to a respective circuit element such as, for example, a respective diplexer 117. The diplexers 117 may be mounted, for example, on the top side 120T of printed circuit board 120. The first end of each coaxial feed cable 180 may be directly connected to a respective one of the circuit elements or may (as shown) be connected to a metal pad 126 on the printed circuit board 120, and the metal pads 126 may be connected to the respective circuit elements through RF transmission lines (not shown) on the printed circuit board 120. The second end of each coaxial feed cable 180 may be connected to the feed point 148, 158 on a respective one of the radiating elements 140, 150 that are mounted on the bottom side 120B of the printed circuit board 120. The coaxial feed cables 180 may transition from the top side 120T to the bottom side 120B of printed circuit board 120 through respective openings 122 that are cut through the printed circuit board 120. Each coaxial feed cable 180 may be used to pass RF signals that are to be transmitted by the antenna system 130 from a respective RF circuit element 110 to a respective one of the radiating elements 140, 150, and to pass RF signals that are received by a respective one of the radiating elements 140, 150 to a respective one of the RF circuit elements 110.

Figure 3C:
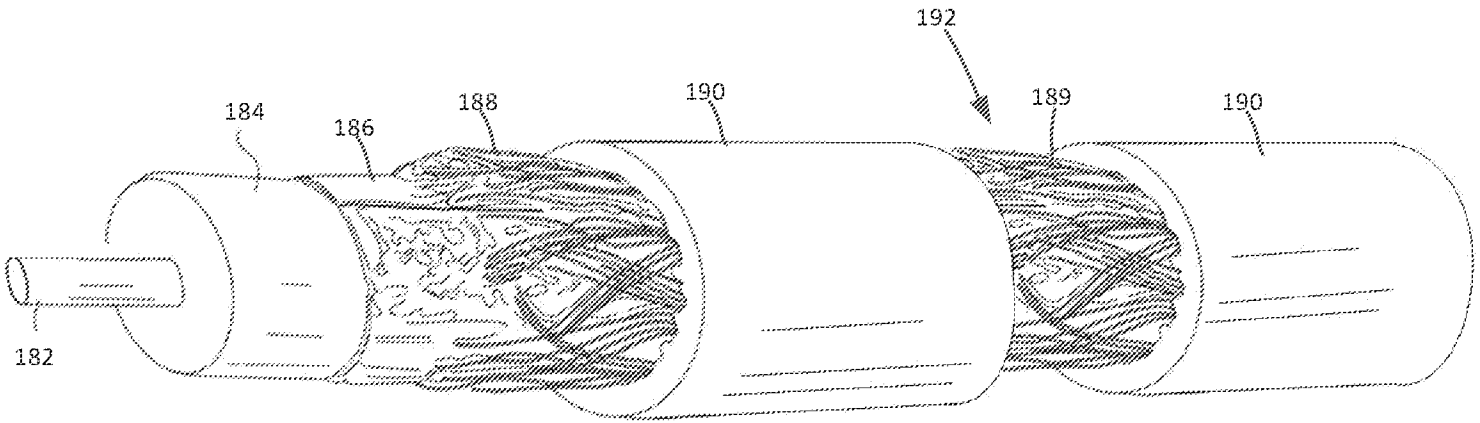
FIG. 3C is an enlarged perspective view of an example of a portion of one of the coaxial feed cables included in the Wi-Fi access point of FIGS. 3A-3B.

Referring now to FIG. 3C, a portion of one of the coaxial feed cables 180 of FIGS. 3A and 3B is shown in greater detail. As shown in FIG. 3C, a central portion 189 of the outer conductor 188 of the coaxial feed cable 180 is exposed through an opening 192 that is provided in the cable jacket 190 thereof. One or more such openings 192 may be included in each of the coaxial feed cables 180 shown in FIGS. 3A-3B. Herein a central portion 189 of the outer conductor 188 refers to any portion of the outer conductor 188 that is between the ends of the cable jacket 190 at the respective ends of coaxial feed cable 180. As shown in FIGS. 3A-3B, the exposed central portions 189 of the outer conductors 188 of the coaxial feed cables 180 may be galvanically connected to the RF ground plane 124. These galvanic connections may set the potential of the outer conductors 188 of the coaxial feed cables 180 at RF ground (which otherwise may not be the case due to the voltage drop that occurs to an RF signal as it traverses a transmission line due to the impedance of the RF transmission line). As discussed above, these galvanic connections between the outer conductors 188 of the coaxial feed cables 180 and the RF ground plane 124 may help suppress the generation of intermodulation products.

In some embodiments, the cable jacket 190 of each coaxial feed cable 180 may include a first opening 192-1 that is located at a distance from a first end of the coaxial feed cable 180 that is approximately one quarter of the operating wavelength of the radiating element 140, 150 that is fed by the coaxial feed cable 180. For example, for a radiating element 140, 150 that operates in the 2.4-2.5 GHz frequency band, the first opening 192-1 may be located approximately 3 cm from a first end of the coaxial feed cable 180. For a radiating element 140, 150 that operates in the 5.725-5.875 GHz frequency band, the first opening 192-1 may be located approximately 1.3 cm from a first end of the coaxial feed cable 180. As yet another example, for a dual-band radiating element that is configured to operate in both the 2.4-2.5 GHz and 5.725-5.875 GHz frequency bands, the first opening 192-1 may be located at (1) approximately 3 cm from a first end of the coaxial feed cable 180 or (2) approximately 1.3 cm from the first end of the coaxial feed cable 180.

The cable jacket 190 of each coaxial feed cable 180 may alternatively or additionally include a second opening 192-2 that is located at a distance from a second end of the coaxial feed cable 180 that is approximately one quarter of the operating wavelength of the radiating element 140, 150 that is fed by the coaxial feed cable 180. Moreover, while it may be advantageous to locate the first and second openings 192-1, 192-2 at approximately one quarter of the operating wavelength from the respective ends of each coaxial feed cable 180, it will be appreciated that embodiments of the present invention are not limited thereto. For example, in other embodiments, the first and second openings 192-1, 192-2 may be located at approximately one eighth or one half of the operating wavelength from the respective ends of each coaxial feed cable 180. Additionally, more than two openings 192 and associated galvanic connections to the RF ground plane 124 may be provided in each coaxial feed cable 180. In some embodiments (including embodiments where the feed cable 180 is coupled to a single band radiating element 140, 150), the two openings 192 may be provided at a quarter wavelength and a half wavelength of the operating wavelength from one end of the coaxial feed cable 180.

While FIG. 3C illustrates a coaxial feed cable 180 that includes an opening 192 that is formed by removing an entire section of the cable jacket 190 that extends 360° around the circumference of the coaxial feed cable 180 in order to divide the cable jacket 190 into first and second spaced apart cable jacket segments, it will be appreciated that embodiments of the present invention are not limited thereto. For example, in other embodiments, the opening 192 may extend less than all the way around the circumference of the coaxial feed cable 180 (e.g., half way around, three quarters of the way around, etc.). As will be discussed in greater detail with reference to FIGS. 5A-5B, in still other embodiments, much smaller openings 192 may be provided such as openings 192 that are formed by one or more insulation piercing contacts that penetrate the cable jacket 190 in order to form a direct galvanic connection with the outer conductor 188 of the coaxial feed cable 180.

Figure 4:
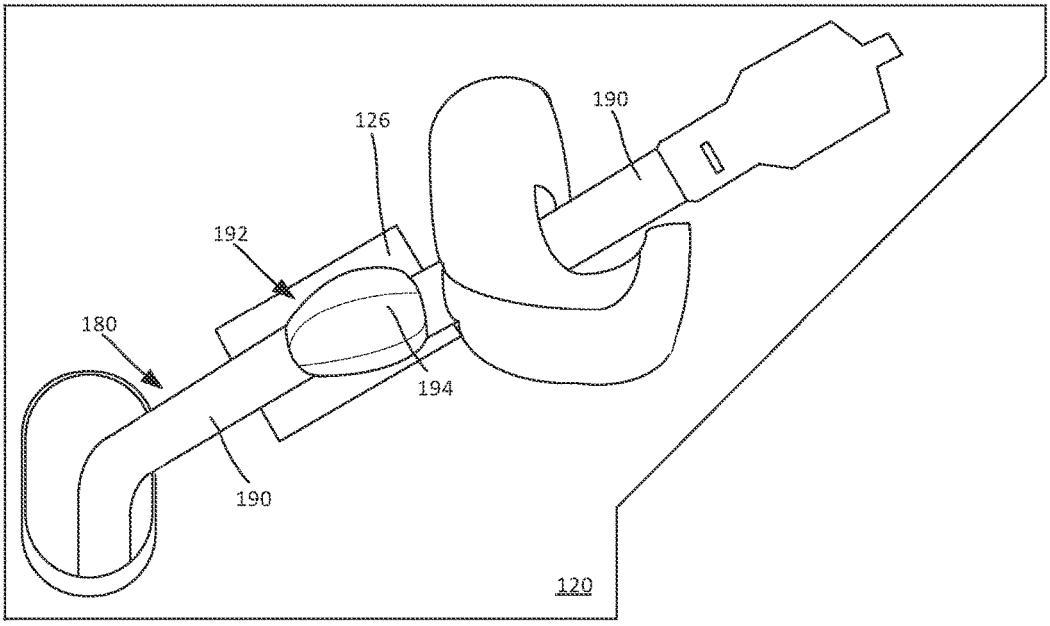
FIG. 4 is an enlarged perspective view illustrating an example of how the outer conductor of one of the coaxial feed cables of FIGS. 3A-3B may be galvanically coupled to the RF ground plane via a solder joint.
Figure 5A:
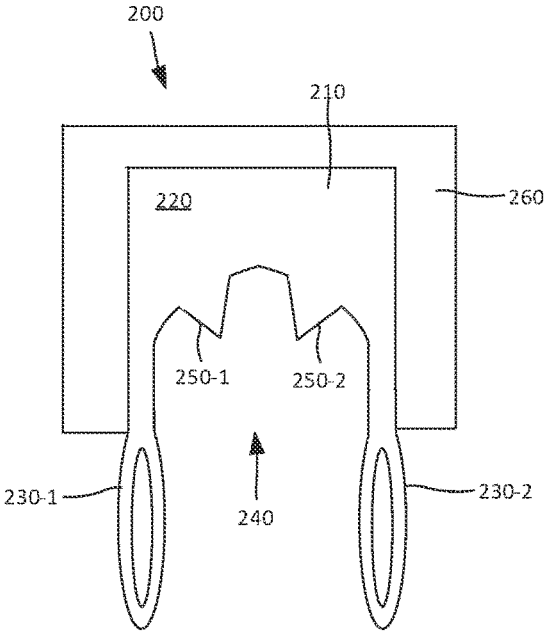
FIG. 5A is a schematic side view an example of of an RF grounding clip according to embodiments of the present invention.
Figure 5B:
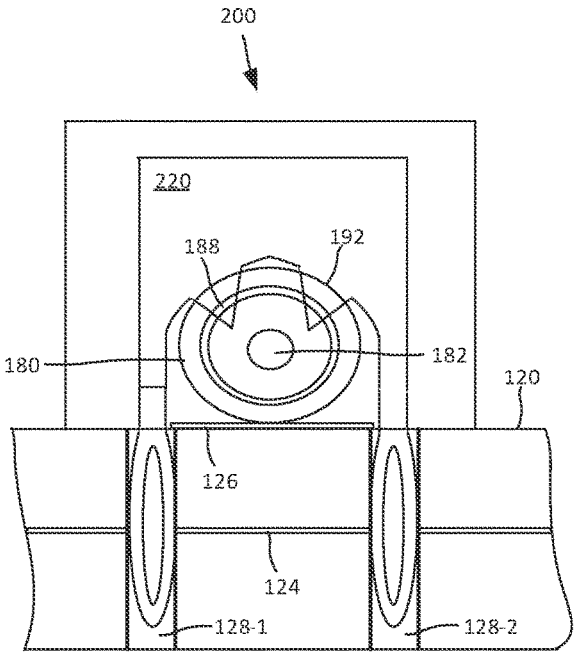
FIG. 5B is a schematic cross-sectional view illustrating how the RF grounding clip of FIG. 5A may be used to galvanically connect the outer conductor of a coaxial feed cable to an RF ground plane in an internal layer of a printed circuit board.

In FIGS. 3A and 3B, solder joints 194 are used to form the galvanic connections and to connect the first end of each coaxial feed cable 180 to a metal pad or other connection on the printed circuit board 120. It will be appreciated, however, that any appropriate technique may be used to form the galvanic connection between the outer conductor 188 of a coaxial feed cable 180 and the RF ground plane. FIG. 4 is an enlarged perspective view illustrating an example of how a solder joint 194 may be used to form the galvanic connection. FIGS. 5A-5B schematically illustrate another representative technique in which a metal clip is used to form the galvanic connection.

FIG. 4 is an enlarged perspective view illustrating how the outer conductor 188 of one of the coaxial feed cables 180 of FIGS. 3A-3B may be galvanically coupled to the RF ground plane 124 via a solder joint 194. As shown in FIG. 4, the printed circuit board 120 may include an exposed metal pad 126 that may be electrically connected to the RF ground plane (e.g., through a plated through hole in the printed circuit board 120). The coaxial feed cable 180 may be routed so that one of the openings 192 (FIG. 3C) in the cable jacket 190 thereof is directly above the metal pad 126. The opening 192 may comprise, for example, a region where a longitudinal section of the cable jacket 190 has been completely removed in order to expose the outer conductor 188 on all sides (i.e., through a full 360°). In other embodiments, the openings 192 may not extend through a full 360° around the circumference of the outer conductor 188. A solder joint 194 may be applied to the portion of the coaxial feed cable 180 that is resting on the metal pad 126 in order to physically and electrically connect the exposed central portion 189 of the outer conductor 188 to the RF ground plane 124.

FIG. 5A is a schematic side view of an example of an RF grounding clip 200 according to embodiments of the present invention. FIG. 5B is a schematic cross-sectional view illustrating an example of how the RF grounding clip 200 of FIG. 5A may be used to galvanically connect the outer conductor 188 of a coaxial feed cable 180 to an RF ground plane 124 in an internal layer of a printed circuit board 120.

As shown in FIGS. 5A and 5B, the clip 200 comprises a metal insert 210 and a plastic over mold 260. The metal insert 210 of clip 200 includes a body 220 and a pair of eye-of-the-needle terminations 230-1, 230-2 that extend downwardly from the body 220 when the metal insert 210 is oriented as shown in FIGS. 5A and 5B. As shown in FIG. 5B, the eye-of-the-needle terminations 230-1, 230-2 may be received within respective plated through-holes 128-1, 128-2 in printed circuit board 120. A trench 240 is formed in a lower portion of the body 220 of metal insert 210 between the pair of eye-of-the-needle terminations 230-1, 230-2. A pair of insulation piercing contacts 250-1, 250-2 extend downwardly from the body 220 into the trench 240. The metal insert 210 may be formed, for example, of sheet metal. The plastic over mold 260 has a slot in a lower surface thereof that receives the body 220 of metal insert 210.

As shown in FIG. 5B, a metal pad 126 is formed on the upper surface of printed circuit board 120 between the metal-plated through-holes 128-1, 128-2. The metal pad 126 may be galvanically connected to the metal-plated through-holes 128-1, 128-2. The RF ground plane 124 may be formed as an interior metal layer in printed circuit board 120, and may be galvanically connected to the metal-plated through-holes 128-1, 128-2. Thus, when the eye-of-the-needle terminations 230-1, 230-2 of clip 200 are inserted into the metal-plated through-holes 128-1, 128-2 the metal insert 210 of clip 200 is galvanically connected to the RF ground plane 124. The metal pad 126 may be located approximately one quarter of the operating wavelength from the end of a coaxial feed cable 180, where the operating wavelength corresponds to the center frequency of the operating frequency band of a radiating element 140, 150 that is fed by the coaxial feed cable 180. Herein, "approximately" encompasses values that are within +/−5% of a recited value. The coaxial feed cable 180 is routed over metal pad 126, and the clip 200 is inserted into the metal-plated through-holes 128-1, 128-2 of printed circuit board 120 so that the coaxial feed cable 180 is located in the trench 240 and is captured between the body 220 of clip 200 and the upper surface of the printed circuit board 120. The insulation piercing contacts 250-1, 250-2 pierce the cable jacket 192 of coaxial feed cable 180 to form respective openings 192 therein so that the metal insert 210 is galvanically connected to the outer conductor 188, thereby galvanically connecting the outer conductor 188 to the RF ground plane 124 in printed circuit board 120. The plastic over mold 260 may provide a thicker structure that makes it easier to insert the eye-of-the-needle terminations 230-1, 230-2 of clip 200 into the metal-plated through-holes 128-1, 128-2 of printed circuit board 120.

While FIGS. 4 and 5A-5B schematically illustrate two techniques for galvanically connecting a central portion of the outer conductor 188 of a coaxial feed cable 180 to the RF ground plane 124, it will be appreciated that numerous other techniques may be used. As one additional example, conductive tape may be used in place of the solder joints 194 in the example of FIG. 4.

Figure 6:
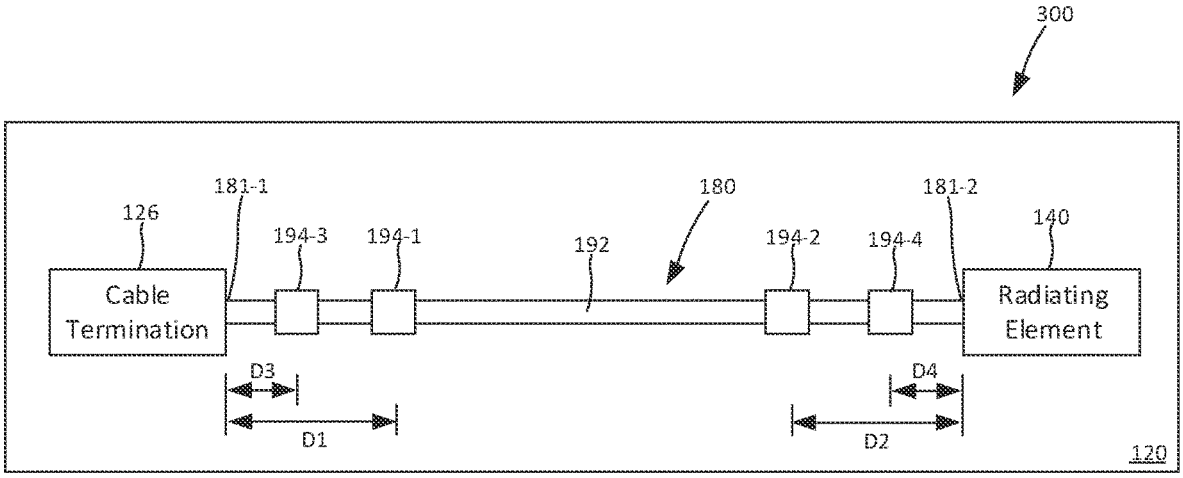
FIG. 6 is a schematic diagram illustrating an example of how one or both ends of a coaxial feed cable that feeds a dual-band radiating element may be galvanically coupled to an RF ground plane in at least two locations in order to suppress generation of intermodulation products.

FIG. 6 is a schematic diagram illustrating how both ends of a coaxial feed cable that feeds a dual-band radiating element may be galvanically coupled to an RF ground plane in at least two locations in order to suppress generation of intermodulation products.

As shown in FIG. 6, a coaxial feed cable 180 may extend between a cable termination and a radiating element 140 in order to provide an RF transmission path between the cable termination and the radiating element. The cable termination may comprise, for example, a metal pad 126 on a printed circuit board 120, a circuit element such as a diplexer, RF switch or RF amplifier, or any other circuit element to which the first end of the coaxial feed cable is connected. The first end 181-1 of the coaxial feed cable 180 may be connected to the cable termination in any appropriate manner including, for example, using clips, conductive tape, soldered connections, coaxial connectors and the like. The radiating element 140 may be configured to operate in two frequency bands, and may be any appropriate radiating element. The radiating elements 140 and 150 that are illustrated in FIG. 3A show two example radiating elements. The second end 181-2 of the coaxial feed cable 180 may be connected to the radiating element 140 in any appropriate manner including, for example, using clips, conductive tape, soldered connections, coaxial connectors and the like.

As is further shown in FIG. 6, at least a portion of the coaxial feed cable 180 may be routed along one or more surfaces of a printed circuit board 120. The printed circuit board 120 may include an RF ground plane 124 (not visible in FIG. 6) that is formed on one or more conductive layers thereof. Four openings 192 (see FIG. 3C) may be formed in the cable jacket 190 of the coaxial feed cable 180. Each opening 192 may expose a respective central portion 189 of the outer conductor 188 of the coaxial feed cable 180. Metal pads 126 (see FIG. 3A) are provided on the surface of the printed circuit board 120 underneath each of the openings 192 in the coaxial feed cable 180. As shown in FIG. 6, solder may be deposited onto the coaxial feed cable 180 and the underlying metal pads 126 at the locations of each of the openings 192 in order to form solder joint 194-1 through 194-4. Each solder joint 194 physically and electrically connects one of the exposed portions of the outer conductor 188 to its respective underlying metal pad 126. The metal pads 126 may be part of the RF ground plane 124 or electrically connected to the RF ground plane 124.

The first solder joint 194-1 may be located at a distance D1 from the first end 181-1 of the coaxial feed cable 180, where the distance D1 is approximately one quarter of a wavelength of the center frequency of the lower operating frequency band of radiating element 140. The second solder joint 194-2 may be located at a distance D2 from the second end 181-2 of the coaxial feed cable 180, where the distance D2 is also approximately one quarter of a wavelength of the center frequency of the lower operating frequency band of radiating element 140. The third solder joint 194-3 may be located at a distance D3 from the first end 181-1 of the coaxial feed cable 180, where the distance D3 is approximately one quarter of a wavelength of the center frequency of the higher operating frequency band of radiating element 140. The fourth solder joint 194-4 may be located at a distance D4 from the second end 181-2 of the coaxial feed cable 180, where the distance D4 is also approximately one quarter of a wavelength of the center frequency of the higher operating frequency band of radiating element 140.

While in the embodiment of FIG. 6, the coaxial feed cable 180 includes openings 192 adjacent both the first and second ends 181-1, 181-2 thereof, it will be appreciated that embodiments of the present invention are not limited thereto. For example, in other embodiments, the coaxial feed cable 192 may only include openings 192 in the cable jacket 190 at either the first end 181-2 or the second end 181-2 thereof. It will also be appreciated that only one opening may be provided at one end of the coaxial feed cable 180 in some embodiments. Thus, it will be appreciated that coaxial feed cables 180 having any combination of the solder joints 194-1 through 194-4 shown in FIG. 6 (e.g., any one of the four solder joints 194, any two of the four solder joints 194, etc.) may be provided according to further embodiments of the present invention.

While the preceding embodiments include particular numbers and arrangements of components, in other embodiments there may be additional or fewer components, two or more components may be combined into a single component, and positions of one or more components may be changed.

Figure 7:
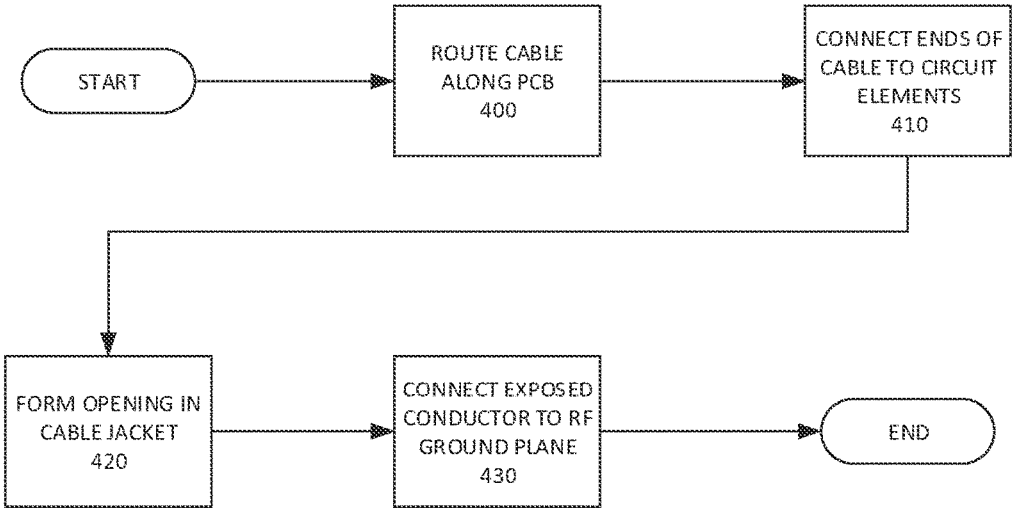
FIG. 7 is a flow chart of an example of a method according to embodiments of the present invention.

FIG. 7 is a flow chart of an example of a method according to embodiments of the present invention. The methods shown in FIG. 7 may be used to suppress the generation of intermodulation products in a wireless radio unit such as a Wi-Fi access point or a CBRS radio unit.

As shown in FIG. 7, a cable such as a coaxial feed cable, may be routed along a printed circuit board of the wireless radio unit (Block 400). The cable may be routed along one or more surfaces of the printed circuit board, and may optionally pass through openings in the printed circuit board. First and second ends of the cable may be connected to circuit elements of the wireless radio unit (Block 410). For example, the first end of the cable may be connected to a radiating element of the wireless radio unit and the second end of the cable may be connected to a front-end RF circuit element of the wireless radio unit, either directly or through an RF transmission line of the printed circuit board. An opening may be formed in the cable jacket of the cable in order to expose a conductor of the cable (Block 420). This opening may be in a central portion of the cable, where the term "central portion" broadly refers to any part of the cable where the cable jacket circumferentially surrounds the inner elements of the cable on both longitudinal sides of the opening. The exposed conductor of the cable may be galvanically connected to an RF ground plane that is provided in the printed circuit board (Block 430). Any appropriate galvanic connection may be used including, for example, a solder joint.

It will be appreciated that FIG. 7 illustrates one example method according to embodiments of the present invention. In other embodiments, the method illustrated in FIG. 7 may include additional or fewer operations. Furthermore, the order of the operations shown in FIG. 7 may be changed, and/or two or more operations may be combined into a single operation. As an example, more than one opening may be formed in the cable jacket of the coaxial feed cable, and the outer conductor that is exposed through each opening may be galvanically connected to the RF ground plane. As another example, the coaxial feed cable(s) shown in the above described embodiments could be replaced with another type of feed cable in other embodiments to provide a plurality of additional embodiments. As still another example, the coaxial feed cable (or other type of feed cable) may be routed along something other than a printed circuit board (e.g., a stamped metal sheet that serves as both a reflector and an RF ground plane) in still further embodiments of the present invention.

Pursuant to further embodiments of the present invention, coaxial feed cables 180 may be provided that have pre-formed openings 192 in the cable jackets 190 thereof that facilitate directly galvanically connecting the outer conductors 188 of these coaxial feed cables to an RF ground plane. In some embodiments, the coaxial feed cables may be formed to have predetermined lengths, and the openings 192 may be formed at predetermined positions in the cable jacket 190. For example, coaxial feed cable may be provided that have lengths of, for example, four inches to twelve inches in one-inch intervals. Each of these different length coaxial feed cable 180 may have opening(s) 192 formed in the cable jacket 190 at, for example, approximately 3 cm from one or both ends thereof (which corresponds to a quarter of a wavelength for radiating elements that operate in the 2.4 GHz frequency band). These coaxial feed cables 180 may additionally or alternatively have opening(s) 192 formed in the cable jacket 190 at, for example, approximately 1.3 cm from one or both ends thereof (which corresponds to a quarter of a wavelength for radiating elements that operate in the 5.8 GHz frequency band). FIG. 3C may be viewed as illustrating one end of a coaxial feed cable 180 that includes such a pre-formed opening 192 in the cable jacket 190 thereof. In still other embodiments, coaxial feed cables may be provided that have pre-formed openings 192 formed in the cable jackets 190 thereof at intervals that correspond to approximately one quarter of a wavelength associated with a center frequency of an operating frequency band of a radiating element that is fed by the coaxial feed cable. Such coaxial feed cables may avoid the need to stock cable segments of different sizes while also avoiding any need to form openings 192 in the cable jackets 190 thereof when installing the coaxial feed cables in an antenna system.

The antenna systems according to embodiments of the present invention may exhibit reduced noise levels and hence may provide enhanced performance. In addition, the techniques described above may allow for a single feed cable to be used to couple signals between dual-band radiating elements and associated RF circuitry of a wireless radio unit. This may reduce the cost of the wireless radio unit.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

While example embodiments have been disclosed above, it will be appreciated that the techniques described herein are widely applicable and that the invention is not limited to the embodiments shown. For example, in some embodiments the RF ground plane may not be implemented as a metal layer in a printed circuit board and instead is implemented in another fashion (e.g., as a sheet metal RF ground plane). The techniques according to embodiments of the present invention are equally applicable with such other types of RF ground plane implementations.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

It will be understood that when an element is referred to as being "on," "coupled to" or "connected to" another element, the element may be formed directly on, coupled to or connected to the other element, or there may be one or more intervening elements therebetween.

Terms such as "top," "bottom," "upper," "lower," "above," "below," and the like are used herein to describe the relative positions of elements or features. For example, when an upper part of a drawing is referred to as a "top" and a lower part of a drawing is referred to as a "bottom" for the sake of convenience, in practice, the "top" may also be called a "bottom" and the "bottom" may also be a "top" without departing from the teachings of the inventive concept.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

Aspects and elements of all of the embodiments disclosed above can be combined in any way and/or combination with aspects or elements of other embodiments to provide a plurality of additional embodiments.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

That which is claimed is:

1. An antenna system, comprising:

a radio frequency ("RF") ground plane;

a radiating element mounted in front of the RF ground plane;

a coaxial feed cable coupled to the radiating element, the coaxial feed cable comprising a center conductor, a dielectric spacer that surrounds the center conductor, an outer conductor that surrounds the dielectric spacer, and a cable jacket that surrounds the outer conductor, wherein the cable jacket comprises a first opening that exposes a first portion of the outer conductor, the cable jacket being on either side of the first opening along a longitudinal direction of the coaxial feed cable, and wherein the first portion of the outer conductor is galvanically connected to the RF ground plane via a first direct galvanic connection.

2. The antenna system of claim 1, wherein the radiating element is configured to operate in a first operating frequency band, and the first opening in the cable jacket is at a distance from a first end of the coaxial feed cable that is approximately one quarter of a wavelength that corresponds to a center frequency of the first operating frequency band.

3. The antenna system of claim 2, wherein the radiating element is also configured to operate in a second operating frequency band that is different than the first operating frequency band.

4. The antenna system of claim 3, wherein twice the center frequency of the first operating frequency band is within 25% of a center frequency of the second operating frequency band.

5. The antenna system of claim 2, wherein the cable jacket comprises a second opening that exposes a second portion of the outer conductor, the cable jacket being on either side of the first opening along the longitudinal direction of the coaxial feed cable, and wherein the second portion of the outer conductor is galvanically connected to the RF ground plane via a second direct galvanic connection.

6. The antenna system of claim 5, wherein the second opening in the cable jacket is at a distance from a second end of the coaxial feed cable that is approximately one quarter of the wavelength that corresponds to a center frequency of the first operating frequency band.

7. The antenna system of claim 1, wherein the first portion of the outer conductor is galvanically connected to the RF ground plane via a solder joint.

8. The antenna system of claim 1, wherein the first opening divides the cable jacket into first and second spaced apart cable jacket segments.

9. The antenna system of claim 1, wherein the RF ground plane is implemented in a printed circuit board and the radiating element is mounted to extend from a front side of the printed circuit board, and wherein the coaxial feed cable extends through an opening in the printed circuit board to connect a circuit element mounted on a back side of the printed circuit board to the radiating element.

10. The antenna system of claim 9, wherein the cable jacket comprises a second opening that exposes a second portion of the outer conductor, and the second portion of the outer conductor is galvanically connected to the RF ground plane via a second direct galvanic connection, and wherein the first direct galvanic connection is on the front side of the printed circuit board and the second direct galvanic connection is on the back side of the printed circuit board.

11. An antenna system, comprising:

a printed circuit board that comprises a metallization layer that is configured to be maintained at radio frequency ("RF") ground when the antenna system is in operation;

a radiating element that is configured to operate in a first operating frequency band;

a feed cable that is coupled to the radiating element, the feed cable comprising a conductor and a cable jacket that surrounds the conductor, wherein a first central portion of the conductor of the feed cable is connected to the RF ground plane via a first galvanic connection that is a direct galvanic connection.

12. The antenna system of claim 11, wherein a first end of the conductor of the feed cable is connected to the RF ground plane via a second galvanic connection and a second end of the conductor of the feed cable is connected to the radiating element via a third galvanic connection.

13. The antenna system of claim 12, wherein the first galvanic connection comprises a first solder joint.

14. The antenna system of claim 11, wherein the first central portion of the conductor of the feed cable is connected to the RF ground plane at a distance from a first end of the feed cable that is approximately one quarter of a wavelength that corresponds to a center frequency of the first operating frequency band.

15. The antenna system of claim 14, wherein the radiating element is also configured to operate in a second operating frequency band that is different than the first operating frequency band.

16. The antenna system of claim 15, wherein twice the center frequency of the first operating frequency band is within 25% of a center frequency of the second operating frequency band.

17. The antenna system of claim 16, wherein a second central portion of the conductor of the feed cable is connected to the RF ground plane via a fourth galvanic connection that is a direct galvanic connection.

18. An antenna system, comprising:

a printed circuit board that comprises a metallization layer that is configured to be maintained at radio frequency ("RF") ground when the antenna system is in operation;

a radiating element that is configured to operate in a first operating frequency band;

a coaxial feed cable that is coupled to the radiating element, the coaxial feed cable comprising an outer conductor and a cable jacket that surrounds the outer conductor, wherein the cable jacket comprises a first opening that exposes a first portion of the outer conductor and a second opening that exposes a second portion of the outer conductor, and the first portion and the second portion of the outer conductor are connected to the metallization layer through the respective first and second openings, wherein the first and second openings are each between a first section of the cable jacket that is adjacent a first end of the coaxial feed cable and a second section of the cable jacket that is adjacent a second end of the coaxial feed cable.

19. The antenna system of claim 18, wherein the first opening in the cable jacket is at a distance from a first end of the coaxial feed cable that is approximately one quarter of a wavelength that corresponds to a center frequency of the first operating frequency band.

20. The antenna system of claim 19, wherein the second opening in the cable jacket is at a distance from the second end of the coaxial feed cable that is approximately one quarter of the wavelength that corresponds to the center frequency of the first operating frequency band.

* * * * *